US007163306B1

(12) United States Patent
Major et al.

(10) Patent No.: US 7,163,306 B1
(45) Date of Patent: Jan. 16, 2007

(54) BOOK SPINE MOUNTED BOOK LIGHT

(75) Inventors: William Robert Major, Oak View, CA (US); William Joseph Major, Penn Valley, CA (US)

(73) Assignee: William R. Major, Ventura, CA (US)

( * ) Notice: Subject to any disclaimer, the term of this patent is extended or adjusted under 35 U.S.C. 154(b) by 24 days.

(21) Appl. No.: 10/870,662

(22) Filed: Jun. 16, 2004

Related U.S. Application Data

(60) Provisional application No. 60/478,176, filed on Jun. 16, 2003.

(51) Int. Cl.
*A47B 19/00* (2006.01)

(52) U.S. Cl. ..... 362/98

(58) Field of Classification Search ..... 362/98
See application file for complete search history.

(56) References Cited

U.S. PATENT DOCUMENTS

| | | | | |
|---|---|---|---|---|
| 2,161,872 | A | 6/1939 | Kostal | |
| 2,524,461 | A * | 10/1950 | McDowell | 362/98 |
| 2,561,744 | A | 7/1951 | Langdon | |
| 2,597,662 | A | 5/1952 | Melamed | |
| 3,586,847 | A | 6/1971 | Nahmias | |
| 3,823,312 | A | 7/1974 | Weinstein | |
| 3,885,145 | A | 5/1975 | Wise | |
| 4,432,042 | A | 2/1984 | Zeller | |
| 4,581,684 | A | 4/1986 | Mazzucco | |
| 4,598,340 | A | 7/1986 | Dwosh et al. | |
| 4,680,681 | A | 7/1987 | Fisherman et al. | |
| 5,280,416 | A | 1/1994 | Hartley et al. | |
| 5,442,528 | A | 8/1995 | Vandenbelt | |
| 5,688,037 | A | 11/1997 | Chen | |
| 5,695,271 | A | 12/1997 | Zeller | |
| 5,820,253 | A * | 10/1998 | Scholz | 362/267 |
| 5,829,903 | A * | 11/1998 | Collins | 401/131 |
| 6,022,119 | A | 2/2000 | Booty | |
| 6,142,644 | A | 11/2000 | Leung | |
| 6,290,368 | B1 | 9/2001 | Lehrer | |
| 6,361,184 | B1 | 3/2002 | Hallgrimsson | |
| 6,419,370 | B1 * | 7/2002 | Chen | 362/98 |
| 2002/0131263 | A1 * | 9/2002 | Naghi et al. | 362/98 |
| 2003/0081407 | A1 | 5/2003 | Bennett | |
| 2003/0133304 | A1 | 7/2003 | Wallach | |
| 2003/0179572 | A1 * | 9/2003 | Schnell | 362/98 |
| 2003/0193795 | A1 | 10/2003 | Brown | |

FOREIGN PATENT DOCUMENTS

| | | |
|---|---|---|
| JP | 05-006701 | 1/1993 |

* cited by examiner

*Primary Examiner*—Ali Alavi
*Assistant Examiner*—William J Carter
(74) *Attorney, Agent, or Firm*—Felix L. Fischer

(57) ABSTRACT

A book light that is removably mounted to a book spine, has a flexible lamp support arm, and provides a rotational device that enables full 360 degree rotation of the lamp support arm about a longitudinal axis of the book spine such that a reader can comfortably hold and read a paperback book folded back upon itself with one hand, a page facing the reader is well illuminated, and subsequent pages can be illuminated by turning the folded book over to a new page and simply rotating the lamp support arm and lamp over the new reading page, all without having to remove and re-mount the book light from the book.

37 Claims, 4 Drawing Sheets

BOOK SPINE MOUNTED BOOK LIGHT

CROSS-REFERENCE TO RELATED APPLICATIONS

Figures 1, 1A:
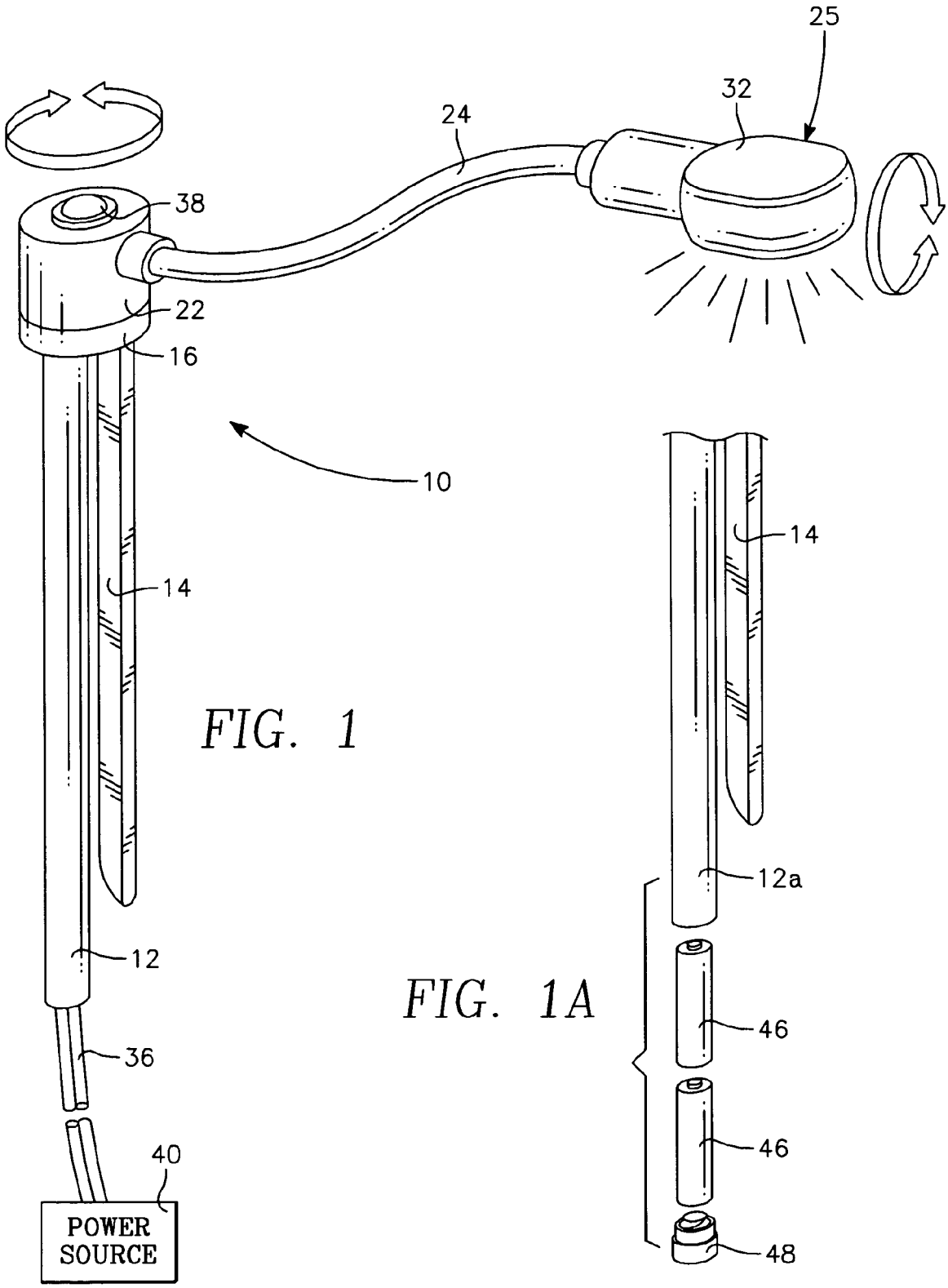

This application claims the benefit of provisional patent application No. 60/478,176, filed Jun. 16, 2003 by the present inventors.

FEDERALLY SPONSORED RESEARCH

Not Applicable

SEQUENCE LISTING OR PROGRAM

Not Applicable

BACKGROUND OF THE INVENTION

1. Field of Invention

This invention relates to a portable book light and, more particularly, to an improved book light that enables a reader to illuminate pages of a paperback book while the book is folded back upon itself in addition to being removably mountable to a book spine for reading paperback books and hardbound books.

2. Discussion of the Prior Art

In general, portable book lights are usually removably mounted in some manner to a book and provide a reader a light source for night reading that will minimally disturb other persons in the room. Book lights also have the advantage of a light source that is close to the book and adjustable over the pages being read. A reader commonly holds the book in an unfolded book reading position which entails having both opposing book pages open and facing the reader. Another common and desired reading position for use with paperback books and magazines is a folded book reading position which entails folding the book back upon itself so that one page faces the reader and the opposing page faces generally in a direction opposite of the reader. Readers of paperbacks, magazines, etc., commonly use the folded book reading position because the book can be easily held in one hand while reading. Readers using the folded book reading position will typically read for several minutes while holding the book with a right or left hand and then switch to the other hand for several minutes, thereby, significantly reducing cumulative hand and arm fatigue. Since book lights are commonly used while reading in bed, readers also desire a book light that operates proficiently with the reader in various positions such as sitting up or lying on their back, side or stomach.

Additionally, readers desire to use book lights that are light weight to reduced hand and arm fatigue. Readers also desire a small and compact book light that does not get in the way of holding the book, turning the pages, and folding the book back upon itself. Readers also desire a book light that is comfortable to use and does not fill a room with too much light so as to disturb a sleeping partner. Readers also desire a light source that is centered over the book pages of a book in the open book reading position to provide generally equal illumination of the opposing pages. Readers also desire a light source that is stable, having minimal wobble or bounce, and if the book is held open at varying angles the resultant light drift across the page will also be minimal. Furthermore, readers also desire a light source that is easily positioned over the pages of a book being read in the folded book reading position. Moreover, readers desire a book light that incorporates and enables all the aforementioned desired features and operations.

Many attempts have been made in prior art to address the problems associated with providing a book light having the aforementioned reader desired features and operations. However, prior art has selectively addressed these problems and has not provided a solution that encompasses all associated problems. Moreover, some reader desired features, such as enabling reading in the folded book reading position, have not been specifically addressed in the prior art.

The prior art discloses several categories of book lights that can be generally described by the method in which the book light is mounted to the book and include book cover types, clip-on types, friction mounting types, and types that do not come in contact with the book. Examples of book holder type book lights, commonly referred to as book cover or book enclosure book lights, are disclosed in U.S. Pat. No. 3,586,847 to Nahmias (1971), U.S. Pat. No. 3,823,312 to Weinstein (1974), U.S. Pat. No. 3,885,145 to Wise (1975), and U.S. Pat. No. 4,680,681 to Fisherman et al. (1987) and are usable for reading in the unfolded book reading position. However, the covers, support structure, and attachment mechanisms of these devices are bulky and restrictive do not enable the reader to efficiently fold a paperback book back upon itself for reading in the folded book reading position. Additionally, because these devices generally cover or enclose the book they are substantially large and heavy and contribute significantly to reader hand and arm fatigue.

Examples of clip-on type book lights are disclosed in U.S. Pat. No. 4,432,042 to Zeller (1984) and U.S. Pat. No. 5,688,037 to Chen (1997). These book lights are mountable to a book cover or a book cover plus a group of pages and are commonly used with hardcover and paperback books. Since these book lights mount to only one side of a book cover or pages, this would allow the paperback book to be folded back upon itself for reading in the folded book reading position. However, these book lights have no effective provision for repositioning the light source over each newly turned page of a folded book. When turning pages while reading in the folded book reading position, these book lights would need to be removed from one cover and clipped back on the opposing cover to illuminate each newly turned page, a highly cumbersome use requirement. Additionally, because these book lights are designed to attach to a flimsy cover and pages of a paperback book, the clip-on mechanisms are made excessively wide to keep light source wobble and bounce to a minimum. A further disadvantage of mounting to the cover and pages of a book is that an off-center mounted light source inherently causes unequal illumination of opposing pages in the open book reading position. Additionally, the off-center mounted light source will drift undesirably across the pages if the reader effects even small changes in the angle in which the book is held open.

Examples of clip-on type book lights designed for use with hardcover books are disclosed in U.S. Pat. No. 2,561,744 to Langdon et al. (1951) and U.S. Pat. No. 2,597,662 to Melamed et al. (1952). These patents disclose book lights that simultaneously clip-on to both opposing outside covers of a hardcover book. The Langdon book light further provides an example of prior art center mounting the book light to produce equal illumination on opposing pages. The Melamed book light accomplishes equal page illumination by providing a separate light source for each opposing page. However, both these devices, because they mount to both opposing covers of the book, would hold the book in the unfolded reading position and not enable the reader to efficiently fold the book back upon itself. Although not the disclosed use, the clip mechanisms disclosed in these patents appear that they could alternatively be mounted to the cover or pages of a paperback book so the paperback could be folded back upon itself. However, the aforementioned disadvantages of Zeller and Chen for off-center paperback book cover and page mounting would apply.

Additionally, the Langdon and Melamed patents disclose book lights that are substantially bulky and heavy.

Another example of a center mounted clip-on book light book for use with hardcover books is disclosed in Japan Patent 05-006701 to Hideo (1993). This patent describes a gap that is formed between a binding section of a page and a central inner surface of a cover when a hardcover book is opened. The patent discloses an attachment clip, like the clip of pocket writing materials, that clips onto the cover and slides into the aforementioned gap. However, this gap does not form when a paperback book is opened and therefore the clip attachment cannot be used as disclosed for paperback books. Since the clip is designed to be used on the flat and thin surfaces of a hardcover book cover it seems reasonable that it could alternatively be mounted to the cover or pages of a paperback book, which, would allow the paperback book to be folded back upon itself. However, again the aforementioned disadvantages of Zeller and Chen for off-center paperback book cover and page mounting would apply.

An example of a friction mounting book light is disclosed in U.S. Pat. No. 5,280,416 to Hartley et al. (1994). This patent discloses a lighting device that can be used as a book light and a bookmark for marking a position in a closed book. This book light is generally wide and flat in configuration, slides in-between pages, and is held in place essentially by friction between the pages or by hand pressure. Since this book light rests between the pages on only one side of the book, this would allow a paperback book to be folded back upon itself for reading in the folded book reading position. However, again the aforementioned disadvantages of Zeller and Chen for off-center paperback book cover and page mounting would apply.

Numerous examples of lighting devices that do not come in contact with the book exist in the prior art. Some of these include desk lamps, bed mounted lamps, flashlights, head mounted lamp, ear mounted lamps, and lamps worn around a person's neck or that rest on a person's chest. All of these would allow reading in the folded book reading position since there is no lighting device mounted to the book to hinder this operation. However, each of these lighting devices have their own significant disadvantages. The following examples, although not all inclusive, provide the background for which the clip-on book light field of invention exists today and is commercially viable. For example, desk lamps and bed post mounted lamps flood a room with too much light and can disturb the reader's partner trying to sleep. Flashlights need to be held, a highly cumbersome use requirement. Head and ear mounted lighting devices can become very uncomfortable to wear after even short periods. And lastly, lamps that are worn around the neck or rest on a person's chest do not work well if a person reads on their back or side.

Hence, the prior art devices are inadequate for meeting the needs of readers as described in the aforementioned reader desired features and operations. As discussed, prior art devices that meet some of these needs suffer a number of other disadvantages. Accordingly, there remains a need for a book light that enables folding a paperback book back upon itself so the book can be held with one hand for reducing hand and arm fatigue, provides an efficient and convenient mechanism for repositioning the light source while reading in the folded book reading position, removably mounts to the center of a book for equal illumination while reading in the open book reading position, is lightweight and compact, and has a stable light source that also drifts minimally with the angle the book is held open.

SUMMARY

The present invention, an improved portable book light, comprises a light source coupled to an adjustable support arm, a rotational device, a front gripping member, and a back gripping member and can be powered by a variety of conventional power sources. The front gripping member and the back gripping member are removably mountable to a book spine or book binding at a front side and a backside of the book spine respectively, wherein the front gripping member and the back gripping member are configured to sandwich the book spine. The front gripping member cross-sectional shape is flat and thin for insertion into a crease formed by a right and a left hand page at the front side of the book spine. The front gripping member flat surfaces slide easily and deeply into the page crease and forms a substantially small bulge between the pages so that the book binding is not harmed and the pages lie essentially flat. The rotational device is configured to provide full 360 degree rotation of the light source and support arm about a longitudinal axis of the book spine and mounted gripping members. This configuration enables a reader to comfortably hold and read a paperback book folded back upon itself with one hand, the page facing the reader is well illuminated, and subsequent pages can be illuminated by turning the folded book over to a new page and simply rotating the support arm and light source over the new reading page, all without having to remove and re-mount the book light from the book.

Furthermore, In the case of paperback books, because the book light gripping members firmly mount to the book spine—making the gripping members and the book spine essentially an integral structure—the book light mounting system can be made substantially more compact and lightweight. Additionally, mounting to the book spine of hardcover and paperback books also positions the light source at the center of the book, thereby providing generally equal illumination to the right and left hand pages of the book held in the open book reading position. Also, because the book spine is generally the most rigid component of the paperback book, mounting to the spine facilitates a stable light thereby significantly reducing light bounce and wobble. Another benefit of the book spine mounted book light is that light drift across the page is held to a minimum for the book being held open at varying angles. These and other objects and advantages of the present invention will become more fully apparent from the following description taken in connection with the accompanying drawings.

DRAWINGS

FIG. 1 is a perspective view of a book light

Figure 2:
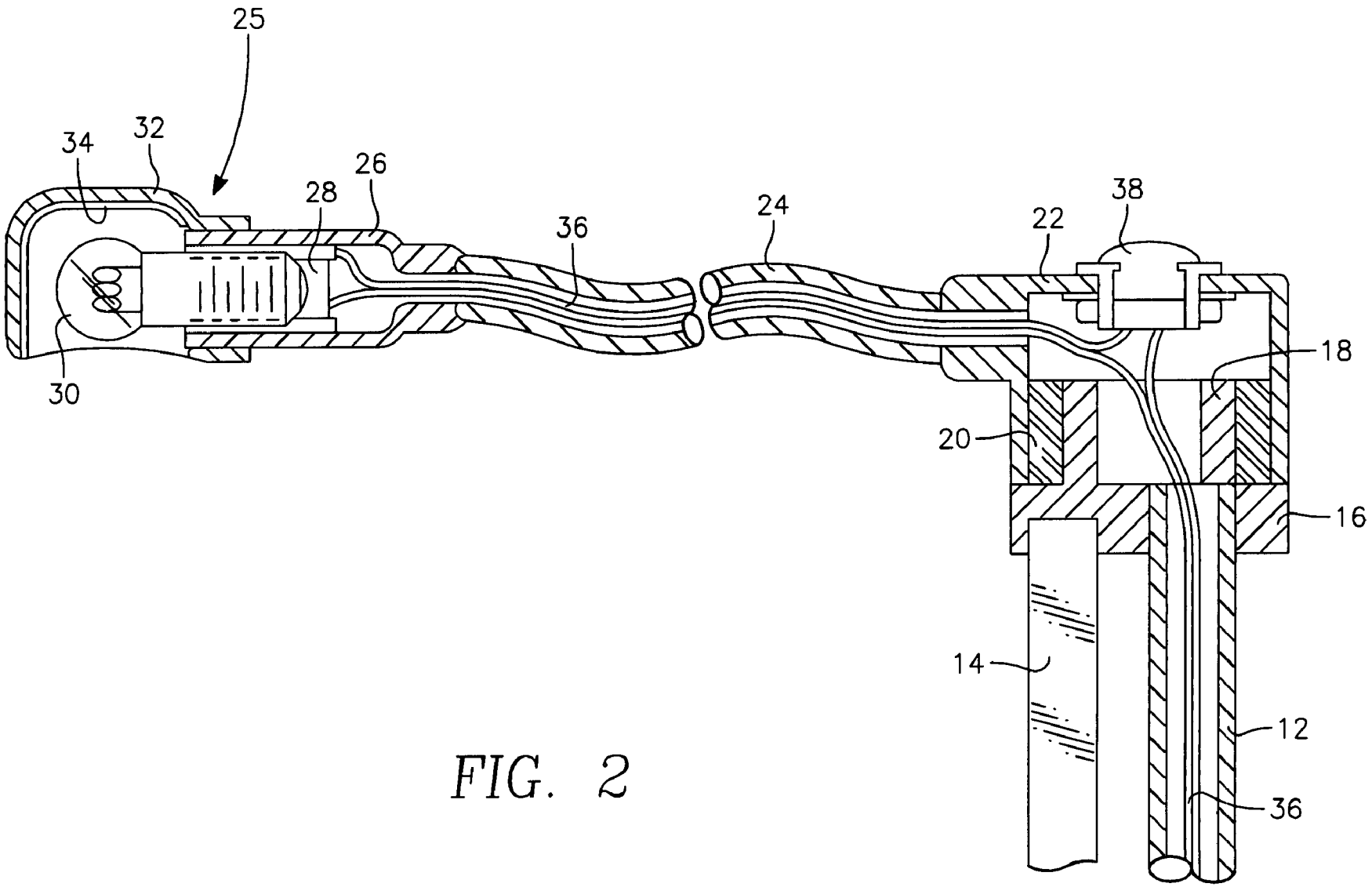
Figure 3:
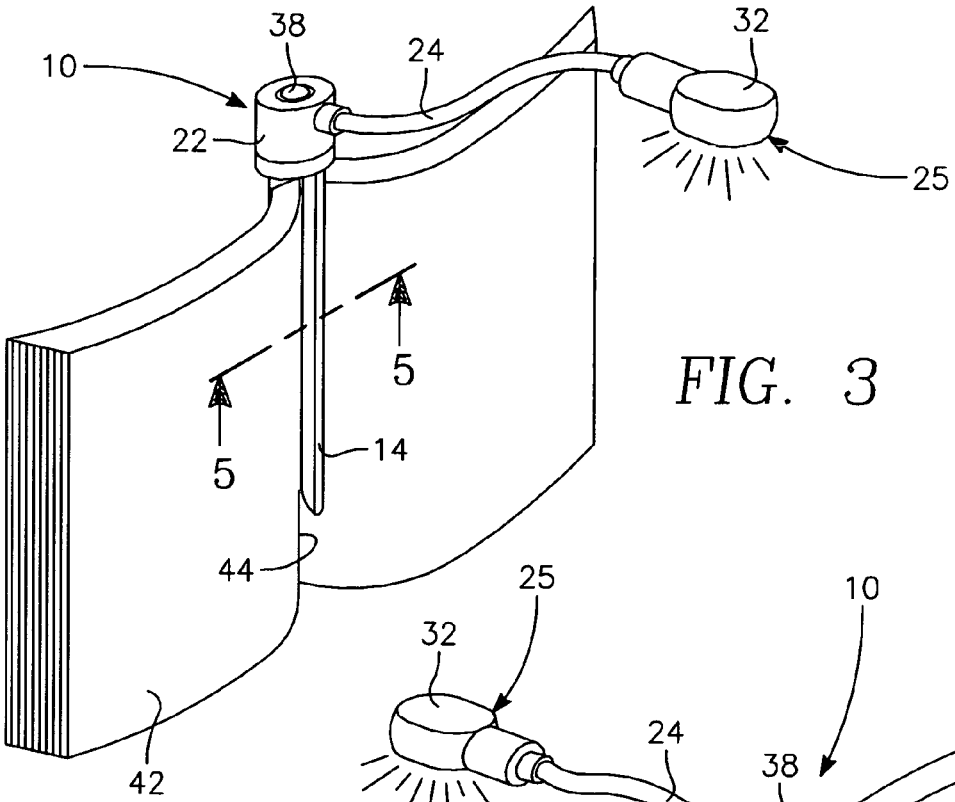
Figure 4:
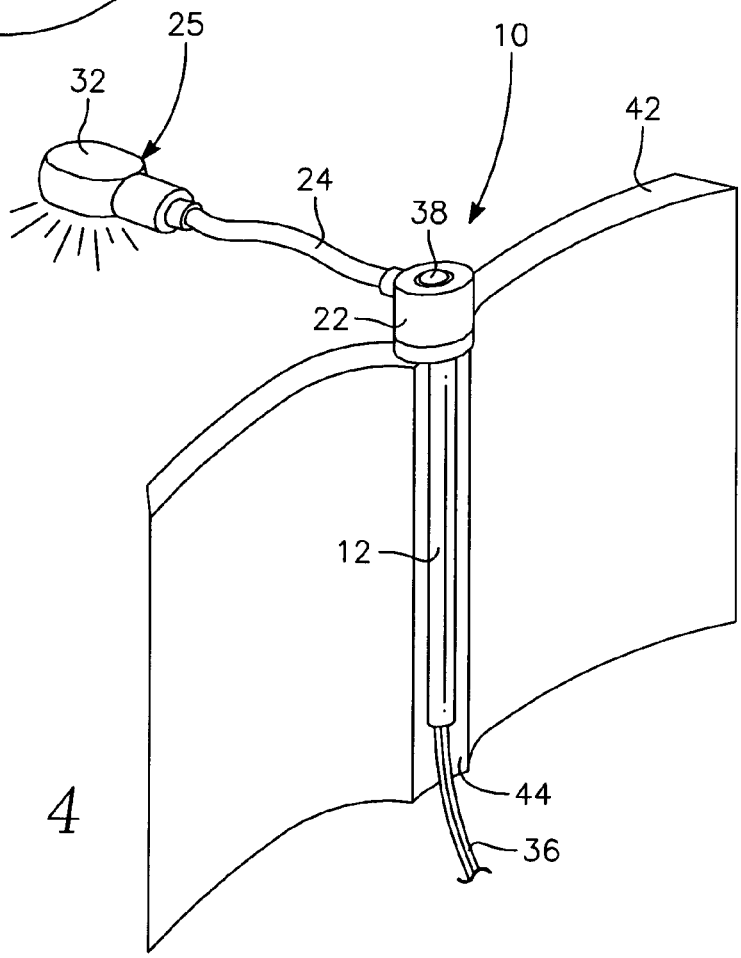
Figure 5:
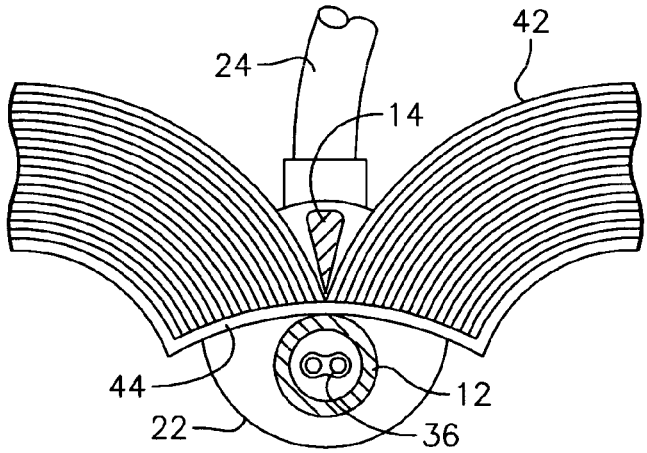

FIG. 1A is a fragment of the lower portion of FIG. 1 modified to show a variation of a back gripping member containing batteries FIG. 2 is a front elevation view of a portion of a book light with gripping members, rotation bearing assembly, flexible arm, and lighting assembly shown in partial cross-section FIG. 3 is a front perspective view of a book light mounted to a book in an unfolded book reading position FIG. 4 is a back perspective view of a book light mounted to a book in an unfolded book reading position FIG. 5 is an enlarged cross-sectional view taken along 5—5 of FIG. 3

Figures 6, 7:
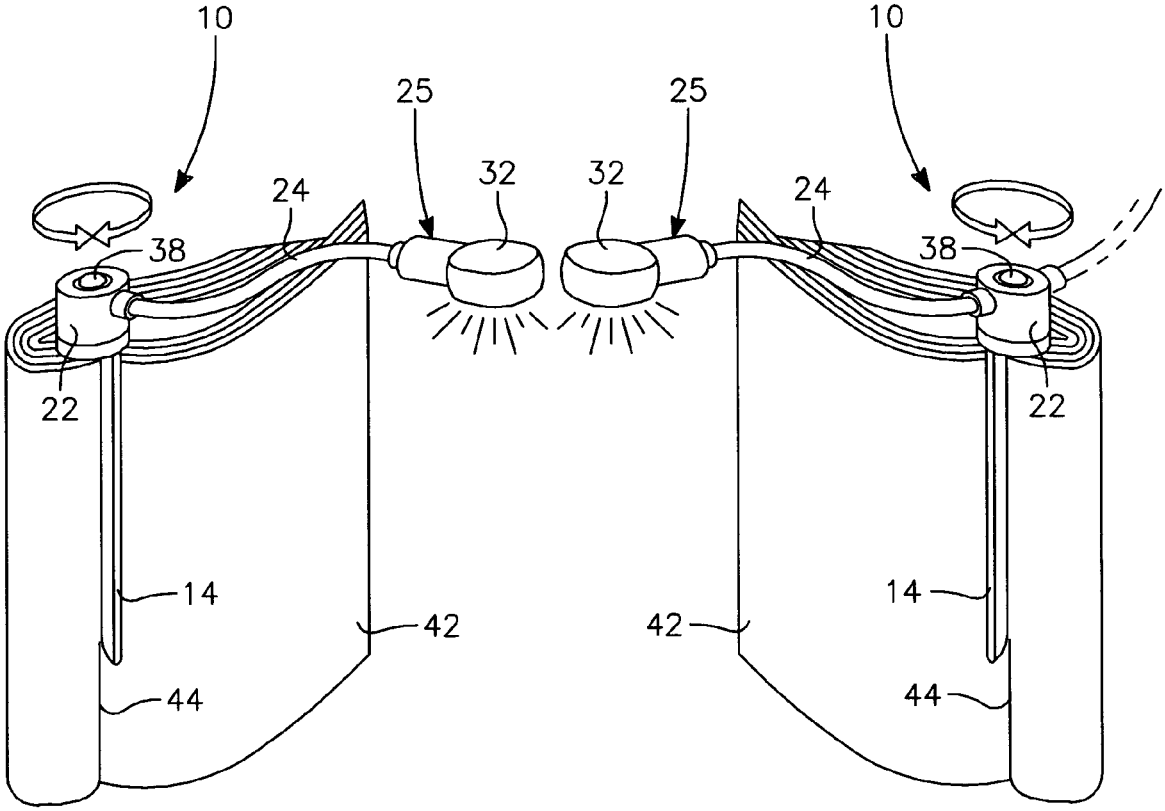

FIG. 6 is a perspective view of a book light mounted to a book that is folded back upon itself with a right-hand page facing towards a reader and a left-hand page facing generally opposite a reader FIG. 7 is a perspective view of a book light mounted to a folded book, that is similar to FIG. 6, showing how a lamp support arm is rotated about a longitudinal axis of a book spine to illuminate a newly turned left-hand page now facing the reader

REFERENCE NUMERALS

10 book light
12 back gripping member
12*a* back gripping member modified to contain batteries
14 front gripping member
16 gripping member base
18 inner stationary bearing
20 middle friction bearing
22 outer rotational bearing
24 flexible arm
25 lighting assembly
26 lamp socket holder
28 lamp socket
30 lamp
32 lamp cap
34 lamp cap reflector
36 electrical conductor
38 on/off electrical switch
40 power source
42 book
44 book spine
46 batteries
48 battery retaining cap

DETAILED DESCRIPTION OF THE PREFERRED EMBODIMENTS

Reference will now be made to the drawings wherein like numerals refer to like parts throughout. A preferred embodiment of the present invention is illustrated in FIG. 1. Book light 10 comprises a back gripping member 12 and a front gripping member 14 for removably mounting book light 10 to a book spine 44 (FIGS. 3 and 4), an outer rotational bearing 22 that is rotatably or pivotably mounted to inner stationary bearing 18 (FIG. 2) to provide 360 degrees rotation of flexible arm 24 about a longitudinal axis of gripping members 12 and 14. Specifically, front gripping member 14 and back gripping member 12 are removably mountable to book spine 44 at a front side and a backside of book spine 44 respectively (FIGS. 3 and 4), so that front gripping member 14 and back gripping member 12 are configured to elastically sandwich book spine 44. Book light 10 further comprises a lighting assembly, or light source, generally indicated in 25 coupled to flexible arm 24 and powered by a conventional electrical power source 40 via electrical conductor 36.

Referring to FIG. 2, it is shown that back gripping member 12 is tubular to contain electrical conductor 36 for routing to lamp socket 28. Back gripping member 12 also may be of a diameter less than 1.3 cm to fit within the back spine of a book in an unfolded book reading position (FIGS. 3 and 4) and a folded book reading position (FIGS. 6 and 7). Furthermore, it is preferable that back gripping member 12 be longer, approximately 1.9 cm, than front gripping member 14 to facilitate easy opening and sliding of gripping members 12 and 14 onto the book spine 44 (FIGS. 3 and 4). Front gripping member 14 has a preferred wedge-shaped cross-sectional shape for insertion into a crease formed by a right-hand and a left-hand page as shown in FIG. 5. While numerous other shapes are suitable, front gripping member 14 wedge shape seats deeply into open book pages (FIG. 3) to securely mount book light 10 (FIG. 1) to the book spine 44 (FIG. 3), forms a minimal bulge between the book pages, and does not harm the book binding. Back and front gripping members 12 and 14 are made of a material, such as plastic, metal, wood, composites, etc, that is sufficiently flexible for separating gripping members 12 and 14 for insertion onto book spine 44 (FIG. 3) while also having sufficient rigidity to securely sandwich book spine 44 between gripping members 12 and 14 once fully inserted. Gripping members 12 and 14 are rigidly attached to gripping member base 16. As shown in FIG. 5, a clearance exists between back gripping member 12 and front gripping member 14 to accept the thickness of book spine 44. This clearance between gripping members 12 and 14 in the vicinity of gripping member base 16 is about 0.25 cm. However, this clearance may be a multiplicity of values such as 0.1 cm, 0.15 cm, 0.2 cm, 0.25 cm, 0.38 cm, 0.51 cm, 0.76 cm, 1 cm, etc.

Inner stationary bearing 18 is rigidly attached to gripping member base 16 as shown in FIG. 2. Middle friction bearing 20 is sandwiched between inner stationary bearing 18 and outer rotational bearing 22 forming a rotational device or more specifically a friction bearing assembly of predetermined or adjustable friction. Middle friction bearing 20 is made of Teflon, nylon, oiled metal, or any suitable material that provides smooth and controlled friction rotation between inner stationary bearing 18 and outer rotational bearing 22. In the FIG. 2 preferred embodiment, the desired bearing friction is accomplished with approximate 0.0025 cm tolerances between bearing parts 18, 20, and 22, however, this may be accomplished with a variety of methods, such as spring loaded bearings, friction hinges, etc. Outer rotational bearing 22 is rigidly attached to flexible arm 24 and enables flexible arm 24 and lighting assembly 25 to rotate 360 degrees (FIG. 1) about the longitudinal axis of gripping members 12 and 14.

Referring again to FIG. 2, lighting assembly 25 comprising lamp socket holder 26, lamp socket 28, lamp 30, lamp cap 32, and lamp cap reflector 34, is rigidly attached to flexible arm 24 at lamp socket holder 26. Flexible arm 24 provides a means to move lighting assembly 25 in any desired direction to achieve optimal illumination over pages of book 42 (FIGS. 3, 4, 6, 7). Flexible arm 24 is also of sufficient stiffness to hold lighting assembly 25 in any desired position. Furthermore, the force required to bend, flex or move flexible arm 24 is greater than the force required to rotate outer rotational bearing 22 such that a reader can rotate lighting assembly 25 about the longitudinal axis of gripping members 12 and 14 without disturbing the desired shape of flexible arm 24, the advantage of which, to be more fully set forth in the description of operation.

FIG. 2 further illustrates electrical conductor 36 solder attachment to lamp socket 28. Lamp socket 28 is pressed fit into lamp socket holder 26 to contain and protect lamp socket 28 and its solder connections to electrical conductor 36. Lamp 30 screws into lamp socket 28. Power to lamp 30 is controlled by a suitable activator such as on/off electrical switch 38 for selectively energizing and de-energizing power source 40. Lamp cap 32 snaps onto lamp socket holder 26 by friction fit and can freely rotate (FIG. 1) about the longitudinal axis of lamp socket holder 26. Rotating lamp cap 32 directs lamp 30 illumination over pages of book 42 (FIG. 3) along an axis transverse to the book spine 44 (FIG. 3). Lamp cap reflector 34 is inserted into lamp cap 32 to focus and intensify illumination of lamp 30.

The power source and wiring for the preferred embodiment of book light 10 is shown generally in FIGS. 1 and 2. While FIG. 1 illustrates an external electrical power source 40 and FIG. 2 illustrates a specific type and routing for electrical conductor 36, it can be appreciated that a multiplicity of such power sources, electrical conductors, and conductor routing, are within the scope of the present invention. In FIG. 2 preferred embodiment electrical conductor 36 is fully enclosed by portable book light 10 such that upon entry into the body of portable book light 10, electrical conductor 36 is fully contained and protected by portable book light 10. In addition, as can be discerned from FIG. 2, differential rotation between back gripping member 12 and outer rotational bearing 22 will cause twisting of electrical conductor 36. This twisting is relieved by allowing electrical conductor 36 to freely rotate within the body of back gripping member 12.

Book light 10 is shown in typical use configurations in FIGS. 3, 4, 6, and 7. FIGS. 3 and 4 illustrate book light 10 configured to be removably mountable to book spine 44, with book 42 in the unfolded book reading position. The wedge-shaped or knife-like edge of front gripping member 14 can be seen in FIGS. 3 and 5 to set deep within the crease between the left and right-hand pages of book 42 at the front side of book spine 44. The round shaped back gripping member 12 can be seen in FIGS. 4 and 5 to fit closely with the curved surface formed by the back side of book spine 44. As shown in FIGS. 3, 4 and 5 book spine 44 is securely sandwiched between back and front gripping members 12 and 14. Once mounted, gripping members 12 and 14 and book spine 44 form a substantially strong integral structure.

FIGS. 6 and 7 illustrate book light 10 mounted to book spine 44 with book 42 folded back upon itself. The folded book reading position is common for soft cover reading materials such as paperback books, magazines, etc., and is preferred by many readers for the ease in which the book can be held in one hand. Outer rotational bearing 22 is configured to enable flexible arm 24 and lighting assembly 25 to rotate 360 degrees about the longitudinal axis of book spine 44. This configuration enables adjustment of lighting assembly 25 over either opposing page of book 42 in the folded book reading position. Because book light 10 attaches to book spine 44 which is at the center of book 42, page illumination before and after rotating lighting assembly 25 to the opposing page of book 42 is symmetrical. Furthermore, attachment to book spine 44 in combination with rotational bearing 22 eliminates the need to remove and re-mount book light 10 for each newly turned page while reading in the folded book reading position. Book light 10, although easily mounted and removed in less than 3 seconds, need only be mounted once during the course of reading an entire book. The mounting of book light 10 to book 42 for reading in the unfolded book reading position (FIGS. 3 and 4) is the same as for mounting to book 42 for reading in the folded book reading position (FIGS. 6 and 7). A reader may switch back and forth at will between the unfolded (FIGS. 3 and 4) and folded (FIGS. 6 and 7) book reading positions without removing and re-mounting book light 10.

The operation of the book light will now be described with reference to FIGS. 3,4,6,7. The manner of use of book light 10 is generally described in three steps as mounting to book, lamp activation and adjustment of lamp to achieve desired page illumination. Referring to FIGS. 3 and 4, attachment of book light 10 to book 42 is accomplished by first opening book 42 to its middle, so that there are approximately the same number of pages to the left and right-hand side of book spine 44. The lower end of back gripping member 12 is then placed against the upper back end of book spine 44 and is flexed forward to open up a space between the ends of back gripping member 12 and front gripping member 14. Gripping members 12 and 14 are then slid over the back and front sides of book spine 44 respectively, essentially sandwiching book spine 44. Gripping members 12 and 14 are slid down book spine 44 until book spine 44 contacts gripping member base 16 (FIG. 2). Book light 10 is now securely mounted to book 42 due to the clamping and friction forces of flexed gripping members 12 and 14 against book spine 44. This attachment location is fully functional for reading all pages of book 42 and does not need to be removed and re-mounted. For a multiplicity of reasons however, such as storage, travel, etc., the reader may chose to remove book light 10 after a reading session and re-mount book light 10 at the start of the next reading session. This method is not a burden to the reader because removal and re-mounting of book light 10 can be easily accomplished in less than 3 seconds. After mounting book light 10, the reader activates lamp 30 with on/off electrical switch 38 as shown in FIG. 2.

Referring to FIGS. 2 and 3, book light 10 is shown mounted to book 42 in the unfolded book reading position. There are three mechanisms the reader can use, singularly or in combination, to adjust lamp 30 illumination over the left and right-hand pages in the unfolded book reading position. Since lamp flexible arm 24 and lighting assembly 25 is advantageously mounted to the center of the book at book spine 44, a desirable adjustment of book light 10 is to simply ensure that lighting assembly 25 is directly over book spine 44 and that lamp 30 is illuminating the left and right-hand pages equally. This over the center adjustment is quickly and easily accomplished by rotating bearing 22 so that flexible arm 24 is aligned with book spine 44, adjusting flexible arm 24 so that lamp 30 illumination is equal from top to bottom of book 42, and rotating lamp cap 32 so that lamp 30 illumination is equal from side to side of book 42. After the reader has adjusted lighting assembly 25 to the desired position, the pages of book 42 can be read and turned in the unfolded book reading position without further adjustment of book light 10 adjustment mechanisms.

Referring to FIG. 6, book light 10 is shown mounted to book 42 in the folded book reading position such that book 42 is folded back upon itself with the right-hand page facing towards the reader and the left-hand page facing away from the reader. In the folded book reading position, the reader adjusts book light 10 similarly to reading the book in the unfolded reading position. The reader first rotates bearing 22 by pushing sideways on flexible arm 24 to position flexible arm 24 over the right-hand page and aligned with book spine 44. As heretofore discussed, it is important to note that when the reader pushes sideways on flexible arm 24 it will activate the rotation of bearing 22 but will not bend or change the shape of flexible arm 24. This is of substantial convenience to the reader because once flexible arm 24 is adjusted, subsequent rotations of bearing 22 do not require additional adjustments of flexible arm 24. It is also important to note that the bearing assembly comprised of 18, 20, and 22 (FIG.

2) provides a predetermined amount of rotational friction such that the reader can easily rotate bearing 22, but once adjusted, bearing 22 will hold flexible arm 24 and lighting assembly 25 at a desired position over book 42. For initial adjustment, flexible arm 24 is then adjusted so that lamp 30 illumination is equal from top to bottom of book 42, and lamp cap 32 is rotated so that lamp 30 sufficiently illuminates of the right-hand page of book 42 in a side-to-side direction. After finishing reading the right-hand page, the reader turns book 42 over so that the left-hand page is now facing the reader and the right-hand page faces away from the reader as shown in FIG. 7. As shown with FIG. 7 phantom lines, with folded book 42 turned over, flexible arm 24 and lighting assembly 25 are now facing in a direction generally opposite the reader. The reader now simply rotates bearing 22 about 90 to 180 degrees to move flexible arm 24 and lighting assembly 25 over the left-hand page now facing the reader. Because book spine 44 does not actually rotate a full 180 degrees when book 42 folded back upon itself is turned over, neither does flexible arm 24 and lighting assembly 25 have to rotate back 180 degrees to illuminate a new page, in fact, flexible arm 24 and lighting assembly 25 advantageously need only rotate back about 90 degrees.

Referring again to FIGS. 6 and 7, it is important to observe that if lamp cap 32 and flexible arm 24 were not over adjusted in the direction of the previous right-hand page, but kept equally adjusted for left and right-hand pages, there will be no further adjustment needed of lamp cap 32 and flexible arm 24 when the reader subsequently turns over book 42 to read the new left-hand page. The reader can therefore turn pages of a folded book and illuminate each new page by simply rotating bearing 22 to position lighting assembly 25 in the desired position over the page. With flexible arm 24 and lamp cap 32 pre-adjusted, rotating bearing 22 to position lighting assembly 25 to the desired position usually requires about one to two seconds thereby providing the reader with an efficient and unobtrusive method to illuminate subsequent pages while reading in the folded book reading position.

The power source and wiring for the preferred embodiment of book light 10 is shown generally in FIGS. 1 and 2. While FIG. 1 illustrates an external electrical power source 40 and FIG. 2 illustrates a specific type and routing for electrical conductor 36, it can be appreciated that a multiplicity of such power sources, conductors, and conductor routing, are within the scope of the present invention. For example, external power source 40 could be a battery, a battery pack, a remote battery, a remote battery pack, an AC wall electrical outlet, an AC/DC voltage converter plugged into an AC wall electrical outlet, or an AC/AC voltage converter plugged into an AC wall electrical outlet all of which may have a multiplicity of source and converted voltage and current values. For further example, although the FIG. 2 preferred embodiment shows electrical conductor 36 protruding from, or entering body of, book light 10 at the end of back gripping member 12, it could protrude from book light 10 at a multiplicity of locations such as at on/off electrical switch 38, outer rotational bearing 22, flexible arm 22, lighting assembly 25, etc. It can be appreciated that having electrical conductor 36 protruding from any components at or between outer rotational bearing 22 and lighting assembly 25 will eliminate undesirable twisting of electrical conductor 36 within the body of book light 10 since these components rotate in unison.

The electrical power source can also be contained internally in book light 10 as shown in FIG. 1A alternative embodiment where batteries 46 are contained within back spine gripping member 12*a*. In this embodiment, batteries 46 are inserted into and are contained by back gripping member 12*a* and battery retaining cap 48 and provide a power source to lamp 30 via electrical conductor 36 and is activated by on/off electrical switch 38. Batteries 46 can be a multiplicity of quantities, configurations and sizes such as two AAAA, AAA, or AA batteries, one AAAA, AAA, or AA battery, watch batteries, etc. Batteries 46 can also be a multiplicity of chemical compositions such as alkaline, lithium, etc. Back gripping member 12*a* is appropriately sized to accept and contain batteries 46.

FIG. 5 shows front gripping member 14 in cross-section as wedge-shaped. However, there are a multiplicity of shapes and sizes that may serve the purpose of securing book light 10, creating a minimal page bulge, and not harming the book binding. For example, front gripping member 14 cross-sectional shape may have generally planer or curvilinear surfaces that are flat and thin for insertion into a crease formed by a right and a left hand page at the front side of book spine 44, wherein the flat and thin planer or curvilinear surfaces of front gripping member 14 are generally orthogonal to the pages and cover of book 42 fully opened on a flat surface. The aforementioned shapes and others such a knife-like, cardioid, etc., are considered applicable. The cross-sectional thickness of front gripping member 14 at its widest point may be for example 0.13 cm, 0.25 cm, 0.3 cm, 0.38 cm, etc.

FIG. 5 also shows back gripping member 12 as having a generally round shape. However, back gripping member 12 cross-sectional shape and thickness may be of a multiplicity of shapes and sizes that are suitable to conform with and remain within the confine of the backside of book spine 44 such that book 42 can be held in a closed, open, and folded back upon itself positions without back gripping member 12 hindering operation of book 42 or damaging book spine 44.

As shown in FIG. 1 back gripping member 12 is longer than front gripping member 14 to facilitate spreading of back gripping member 12 and front gripping member 14 for sliding onto and elastically sandwiching book spine 44. However, it can be appreciated that front gripping member 14 may also be longer than back gripping member 12 to facilitate spreading gripping members 12 and 14. FIG. 1 also shows gripping members 12 and 14 as substantially elongated and as such gripping members 12 and 14 may be a multiplicity of lengths for example 1.3 cm, 2.5 cm, 5 cm, 7.5 cm, 10 cm, 12.5 cm, 15 cm, etc.

As shown in FIG. 2 preferred embodiment, lamp 30 is an incandescent lamp. However, lamp 30 may be a multiplicity of light sources such as florescent lamps, light emitting diodes, etc. that are within the scope of the present invention.

Although the description above contains many specificities, these should not be construed as limiting the scope of the invention but as merely providing illustrations of some of the presently preferred embodiments of this invention. For example, the gripping members may have a multiplicity of other lengths and shapes, such as oval, triangular, etc., with the purpose of the lengths and shapes to grip the book spine securely but also not damage or hold the book pages open—front spine gripping members that are rectangular with the long side parallel to book pages, square, or in general any shape or width that creates a substantial bulge when inserted into the crease where opposite book pages are joined, will damage and hold those pages open thereby interfering with turning pages and reading all other pages of the book; the ends of the gripping members may be connected with an elastic band that loops around the bottom or top of a book to provide additional holding strength; the book light gripping members may be inserted on the top or the bottom of a book; the back or front gripping members may be provided with an adjustable mechanism, such as telescoping, elastic, etc., to grip the bottom and the top of a book; the flexible arm and lighting assembly may rotate perpendicular or parallel to any axis of the book light to achieve illumination of the opposite side of a folded book; the book light may be mounted to any type of book, such as paperback, hardback, magazine, periodical, etc., or, to any object that requires illumination; the book light may be made of any material, such as, thermoplastics, epoxy plastics, composite plastics, wood, metals, metal composites, etc.; the electrical on/off switch can be located at a multiplicity of locations on the book light, on the book light electrical conductor, or on the book light power source and be any suitable type of switch, such as, pushbutton, toggle, mercury, linear, rotation, dimmer switch, cord switch, etc.; the friction bearing assembly may be of any type or shape, such as, ball and socket, spring, clamp, adjustable screw, deformed washer, friction, multi-position, and be made of any suitable material, such as, Teflon, nylon, thermoplastics, epoxy plastic, wood, metal, etc.; the outer rotational bearing may freely and continuously rotate 360 degrees in the clockwise or counterclockwise direction as shown in the preferred embodiment or may have limited rotation such as 360 degree stops, 480 degree stops, 720 degree stops, etc., to prevent the electrical conductor from over twisting; the preferred embodiment depicts a design that allows the inner electrical conductor to freely turn inside the rotational bearing and back gripping member thereby allowing the rotational bearing continuous 360 degree rotation, however, this conductor may be designed to not freely turn when integrated with a rotational bearing that has limited rotation stops; the preferred embodiment depicts a design where the electrical conductor is fully protected once entering the book light but alternative embodiments may exist where the conductor goes out and back in to the book light; the flexible arm or adjustable support arm that supports the lighting assembly can be flexible, semi-flexible, gooseneck, rigid, rigid with adjustment hinges or ball joints, etc.; the lamp and lamp socket can be a multiplicity of types, manufactures, sizes, shapes, pin and screw designs, voltage and wattage ratings, etc.; the book light can be stored when not in use in a multiplicity of ways such as contained in a compact disk or CD-like case, a rectangular box, a pouch of flexible material, etc.

Thus, the scope of the invention should be determined by the appended claims and their legal equivalents, rather than by the examples given.

I claim:

1. A portable book light, comprising:

a front gripping member having a thin cross-sectional shape with planer surfaces for insertion into a crease formed by a right and a left hand page at a front side of a book spine, wherein the thin planer surfaces of said front gripping member are generally orthogonal to the spine, and a back gripping member;

a light source;

said light source coupled to said front gripping member and said back gripping member; and said front gripping member and said back gripping member removably mountable to the book spine at the front side and a backside of said book spine respectively, wherein said front gripping member and said back gripping member are configured to sandwich said book spine.

2. The portable book light of claim 1, wherein said front gripping member and said back gripping member are configured to elastically sandwich said book spine.

3. The portable book light of claim 1 wherein an edge of said front gripping member adjacently spaced from said back gripping member is curvilinear to facilitate said front gripping member sliding easily and deeply into the page crease, the thin profile of said front gripping member forming only a small bulge in the pages between which said front gripping member is inserted.

4. The portable book light of claim 1 wherein said front gripping member cross-sectional shape is generally wedge-shaped for insertion into a crease formed by a right and a left hand page at the front side of said book spine.

5. The portable book light of claim 1 wherein said back gripping member cross-sectional shape and thickness is suitable to conform with and remain within the confine of the backside of said book spine whereby the book can be held in the closed, open, and folded back upon itself positions without said back gripping member hindering operation of said book.

6. The portable book light of claim 1 wherein said back gripping member cross-sectional shape is generally round.

7. The portable book light of claim 1 wherein said back gripping member is longer than said front gripping member to facilitate spreading of said front gripping member and said back gripping member to slide onto and elastically sandwich said book spine.

8. The portable book light of claim 1 wherein said front gripping member and said back gripping member are substantially elongated.

9. The portable book light of claim 1 wherein said front gripping member and said back gripping member are at least 7.5 cm long.

10. The portable book light of claim 1 wherein a clearance is formed at a base of and between said front gripping member and said back gripping member to accept thickness of said book spine.

11. The portable book light of claim 10 wherein said clearance is at least 0.15 cm.

12. The portable book light of claim 10 wherein said clearance is less than 0.75 cm.

13. The portable book light of claim 1 wherein said light source is pivotably mounted to said front gripping member and said back gripping member.

14. The portable book light of claim 1 wherein said light source is rotatably mounted to said front gripping member and said back gripping member to enable rotating said light source 360 degrees about a longitudinal axis of said book spine whereby a reader can rotate said light source to an opposite side of a paperback book folded back upon itself without having to remove and re-mount said portable book light.

15. The portable book light of claim 1 further comprising a power source for selectively energizing said light source.

16. The portable book light of claim 15 further comprising an activator for selectively energizing and de-energizing said light source.

17. The portable book light of claim 15 wherein said power source is a battery contained in the body of said portable book light.

18. The portable book light of claim 17 wherein said battery is contained within the body of said back gripping member.

19. The portable book light of claim 1 wherein said portable book light receives power from at least one of a battery, a battery pack, a remote battery, a remote battery pack, an AC wall electrical outlet, an AC/DC voltage converter plugged into said AC wall electrical outlet, and an AC/AC voltage converter plugged into said AC wall electrical outlet.

20. The portable book light of claim 1 further including an electrical conductor for transmitting power from a remote power source to said light source.

21. The portable book light of claim 20 wherein said electrical conductor protrudes from said back gripping member.

22. The portable book light of claim 20 wherein said electrical conductor protrudes from said portable book light in the vicinity of said light source whereby said electrical conductor moves in unison with said light source such that any rotational movement of said light source causes no twisting of said electrical conductor within the body of said portable book light.

23. The portable book light of claim 20 wherein said electrical conductor is fully enclosed by said portable book light whereby upon entry into body of said portable book light said electrical conductor is fully contained and protected by said portable book light.

24. The portable book light of claim 1 wherein said light source contains at least one of an incandescent lamp, a florescent lamp, and a light emitting diode.

25. A portable book light, comprising:

a light source and an adjustable support arm;

a rotational device;

a first gripping member and a second wedge shaped gripping member depending from said rotational device, said second gripping member held adjacent to and spaced from the first member for engagement deep within the crease between pages adjacent a spine of a book;

said light source coupled to said adjustable support arm;

said rotational device coupled to said adjustable support arm;

said gripping members removably mountable to the book spine; and said rotational device is rotatably mounted to said gripping members to enable rotating said light source and said adjustable support arm 360 degrees about a longitudinal axis of said book spine.

26. The portable book light of claim 25 wherein said gripping members are configured to elastically sandwich said book spine.

27. The portable book light of claim 25 wherein said rotational device is a friction bearing assembly of predetermined friction whereby said reader applies a light hand pressure to rotate said friction bearing and said friction bearing holds said light source at desired position over a book page upon release of said light hand pressure.

28. The portable book light of claim 25 wherein said rotational device is a friction bearing assembly of selectable friction whereby said reader applies a light hand pressure to rotate said friction bearing and said friction bearing holds said light source at desired position over a book page upon release of said light hand pressure.

29. The portable book light of claim 25 wherein said rotational device allows rotational movement only about the longitudinal axis of said book spine whereby said light source and said adjustable support arm maintain their current shape and previous adjustments and are not altered by rotation of said rotational device.

30. The portable book light of claim 25 wherein said adjustable support arm is a substantially elongated gooseneck flexible arm.

31. The portable book light of claim 25 wherein said adjustable support arm is a substantially elongated member rotatably coupled to said rotational device and said light source.

32. A method for illuminating pages of a paperback book for reading said paperback book in the position of being folded back upon itself, comprising the steps of:

a) providing a portable book light comprising a first gripping member and a second wedge shaped gripping member held adjacent to the first member for engagement deep within the crease between pages adjacent a spine of a book for removably mounting to the spine, a light source coupled to a support arm, and a rotational device joining said gripping members and said support arm wherein said support arm can rotate 360 degrees about a longitudinal axis of said book spine, b) removably mounting said gripping members to said book spine of said paperback book, c) rotating said support arm about the longitudinal axis of said book spine to position said light source over the folded page facing a reader of said paperback folded back upon itself, d) turning said paperback book over so that a current folded page faces away from the reader and a new folded page faces towards the reader, and e) rotating said support arm about the longitudinal axis of said book spine wherein said light source is positioned over the new folded page, whereby the reader can comfortably hold the folded said paperback book with one hand while reading, the page facing the reader is substantially well illuminated, and subsequent pages can be illuminated by turning the folded said paperback book over to a new page and simply rotating said support arm and said light source over the new folded page, all without having to remove and re-mount said portable book light.

33. The method of 32 wherein said gripping members comprise at least a front gripping member and a back gripping member removably mountable to said book spine at a front side and a backside of said book spine respectively, wherein said front gripping member and said back gripping member are configured to sandwich said book spine.

34. A portable book light comprising:

a base assembly;

a first member depending from the base assembly and having a substantially cylindrical surface for engagement with an outer surface of a book spine;

a blade shaped second member depending from the base in spaced relation from the first member and substantially perpendicular to a tangent to the cylindrical surface of the first member for insertion between pages of the book deeply within the crease immediately adjacent the spine, the spine of the book restrained intermediate the first and second members;

a flexible arm extending from the base assembly;

a lighting assembly mounted to the flexible arm distal the base assembly; and, means for providing power to the lighting assembly.

35. The portable book light of claim 34 wherein the base assembly includes a bearing mounted to a base plate opposite the depending members for rotation about an axis substantially parallel to the first and second members and wherein the flexible arm is mounted to the bearing.

36. The portable book light of claim 34 wherein the means for providing power comprises:

at least one battery contained within the first member;

contact means within the first member engaging electrical terminals on the battery; and, wiring extending from at least one of said contact means to the lighting assembly.

37. The portable book light of claim 35 wherein the base plate is substantially cylindrical and the bearing is substantially cylindrical and mounted concentric to the base.

* * * * *